United States Patent [19]

Charonnat et al.

[11] Patent Number: 4,678,364

[45] Date of Patent: Jul. 7, 1987

[54] TRACTOR-DRAWN FORMING TOOL FOR MAKING CONCRETE SLABS ON THE GROUND

[75] Inventors: Yves Charonnat, Port Saint Pere; Lucien Larribe, La Celle St. Cloud, both of France

[73] Assignee: VIAFRANCE and State of France as represented by the Ministry of Urban Planning, Housing and Transportation, Central Laboratory of Roads and Bridges, Paris, France

[21] Appl. No.: 839,354

[22] Filed: Mar. 13, 1986

[30] Foreign Application Priority Data

Mar. 14, 1985 [FR] France ..... 85 03729

[51] Int. Cl.[4] ..... E01C 19/22

[52] U.S. Cl. ..... 404/105; 404/84; 404/116; 404/118; 425/63

[58] Field of Search ..... 404/84, 101, 102, 104–106, 404/113–116, 118, 119; 425/62, 63, 219, 456

[56] References Cited

U.S. PATENT DOCUMENTS

| | | | |
|---|---|---|---|
| 2,255,343 | 9/1941 | Baily | 404/114 |
| 2,303,486 | 12/1942 | McConnaughay | 404/105 |
| 2,511,589 | 6/1950 | Jaeger | 404/105 |
| 2,757,588 | 8/1956 | Pollitz | 404/114 |
| 3,035,499 | 5/1962 | Domenighetti | 404/105 |
| 3,354,801 | 11/1967 | Hanson | 404/105 |
| 3,602,115 | 8/1971 | Hanson | 404/105 |
| 3,709,116 | 1/1973 | Whitbread et al. | 404/105 X |
| 3,997,277 | 12/1976 | Swicher, Jr. et al. | 404/84 |

FOREIGN PATENT DOCUMENTS 1784966 1/1972 Fed. Rep. of Germany .

*Primary Examiner*—Stephen J. Novosad
*Assistant Examiner*—John F. Letchford
*Attorney, Agent, or Firm*—Browdy and Neimark

[57] ABSTRACT

A forming tool made to be drawn by tractor-feeder means of any type. The tool comprises two arms mounted to pivot by their front ends on the tractor-feeder. At the back end of the arms is mounted a needle ramp for immersion vibration so as to keep the concrete delivered and distributed by the tractor-feeder in the liquid state before its forming. The forming means comprise an upper element which has a front part in the form of a shield for the regulation of the amount of concrete introduced under the form, and a back part serving as forming upper plate and simultaneously as back reference and support means for levelling the tool, the latter being entirely carried by the formed concrete layer. Side forming plates are also provided.

10 Claims, 4 Drawing Figures

42
46
48
50
52
58
44b
44b'
56
47
40
24
72
66
68
70
18
41
44a
34
26
16
74

24
33
32
28
26
31
30

24
50
45
46
47
47'
46'
42
49
52
48
51

TRACTOR-DRAWN FORMING TOOL FOR MAKING CONCRETE SLABS ON THE GROUND

FIELD OF THE INVENTION

The present invention relates to tools for making concrete slabs for roads or the like, and more to particularly to a forming tool of the sliding form type.

BACKGROUND OF THE INVENTION

Machines known as sliding form machines are already known in the art in which a predetermined amount of cement concrete is deposited on the ground by feeder means, then subjected to a forming under vibration using upper and side form plates mounted solid with the frame.

However, in this type of machine the concrete layer is made between the supports of the machine, which requires the use of a tractor unit of the straddling type, whose side bulk is disadvantageously great. This type of machine therefore imposes a limit on the width of the slab to be made which is compatible with the tractor path itself, except for major mechanical interventions.

Moreover, this type of requires a complex altimetric guide system with a minimum of four height-adjusting jacks which act as rigid connections between the sliding form and the frame of the machine. These jacks are provided to compensate for the defects of the traveling surface of the tractor unit, by preventing these defects from impacting on the quality, or smoothness, of the layer of concrete formed. In particular, such a system is most often poorly suited to compensating for sudden movements or impacts, both vertical and horizontal, exerted on the machine.

SUMMARY OF THE INVENTION

It is an object of this invention to alleviate these drawbacks and to provide a molding tool of the sliding form type with which a concrete slab exhibiting a satisfactory smoothness can be made simply and efficiently.

Another object of this invention is to provide a piece of equipment for molding with sliding form which can be easily adapted to any tractor-feeder unit whatsoever, and particularly nonstraddling type. Therefore, slabs of any width can be made totally independent of the crosswise dimensions of the tractor-feeder unit.

For this purpose, this invention relates to a forming tool of the sliding form type made to be tractor-drawn by any tractor-feeder unit able to deposit the concrete on the ground in a predetermined amount, characterized in that it comprises:

two hitching arms able to be mounted to pivot at their front end, for traction;

immersion vibration means mounted downstream from the tractor-feeder unit and made to subject the concrete to a vibration; and forming means resting by their own weight on the formed concrete slab, comprising side elements for confinement of the concrete and an upper element consisting of a front part mounted rigidly in the region of the back end of the arms downstream from the immersion vibration means and forming a regulator of the amount of formed concrete, and of a back part simultaneously forming an upper molding plate and back reference and support means for carrying said tool, which is thus carried by the formed concrete slab.

DESCRIPTION OF THE DRAWINGS

The invention will be better understood after reading the following detailed description of a preferred embodiment of the invention, given by way of example and made with reference to the accompanying drawing in which.

Figure 1:
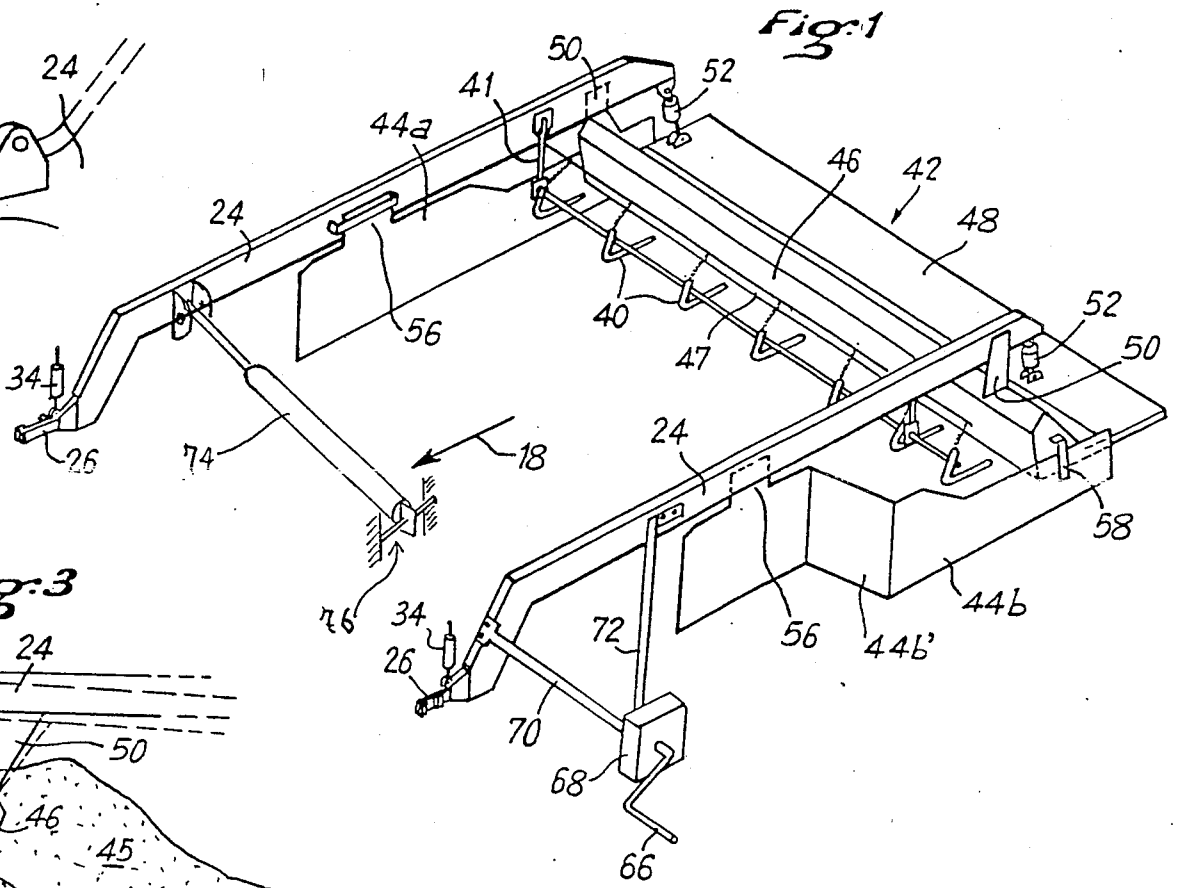
FIG. 1 is a general view in perspective of a tool for making concrete slabs according to the invention.

With reference to the drawing, and first in FIG. 1, a molding tool for making concrete slabs, particularly for roads and the like, is shown in the form of a unit made to be tractor-drawn by a tractor-feeder piece of equipment of any type whatsoever, not shown. Purely by way of example, the tractor-feeder piece of equipment will be able to take the form of a road machine having a cement concrete receiving hopper, conveyor or other means for conveying the concrete to the ground at the back of the machine, and means for spreading or distributing the concrete in a relatively uniform way on the ground, for example, with crosswise Archimedes' screws.

Figure 2:
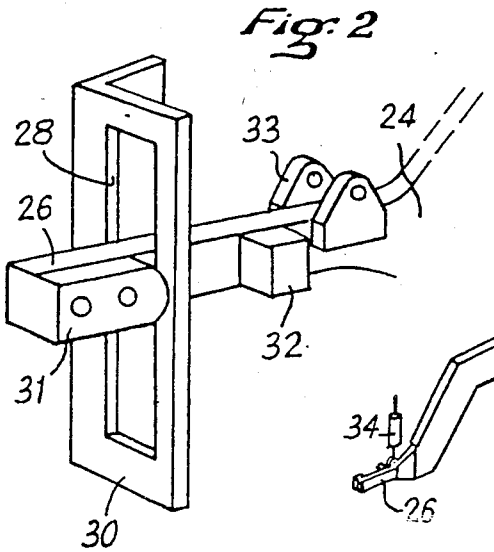
FIG. 2 is a view in perspective of a detail of the tool shown in FIG. 1.

Thus the unit or moding tool according to the invention comprises two longitudinal side hitching arms 24 which are made to insure the connection between the frame of the tractor-feeder device with which it is associated and the actual elements of the tool. More precisely, and also with reference to FIG. 2, each hitching arm 24 exhibits at its front end, on the left in FIG. 1, hooking means consisting of a longitudinal tie rod 26 which goes through a vertical slide 28 made in an angle bracket 30 which is either integral with the frame of the above-mentioned device, or added to it and fastened in place by any suitable means such as welding, bolting, etc. Tie rod 26 comprises two parts 31, 32 in side projection and longitudinally separate, between which angle bracket 30 is held, projecting part 31 of course being removable and fastened in place after the insertion of the free end of tie rod 26 in slot 28. Thus, for purposes explained in detail later on, a hitching is defined (the traction being performed by cooperation between projecting part 31 and slide 28) provided with certain degrees of freedom vertically and horizontally. Further, close to part 32 is provided a fork 33 (FIG. 2) for mounting the lower end of a height-adjusting jack 34 (FIG. 1), whose upper end will be fastened to the frame of the tractor-feeder device. In certain cases, jack 34 can be replaced with a simple height-adjusting device such as a crank or the like.

The forming tool itself consists of the following elements:

immersion vibration means which is this embodiment exhibit the form of a vibration needle ramp, diagrammatically indicated as 40, said ramp being fastened to the back end region of hitching arms 24 with suitable standards 41; these needles 40, no longer desribed in detail because they are standard, are made to keep the cement concrete in the liquid state just before its molding by means described below; and molding a mold or sliding mold which comprises an upper horizontal molding element 42 and, in this example, two side molding plates **44*a* and 44*b***.

Figure 3:
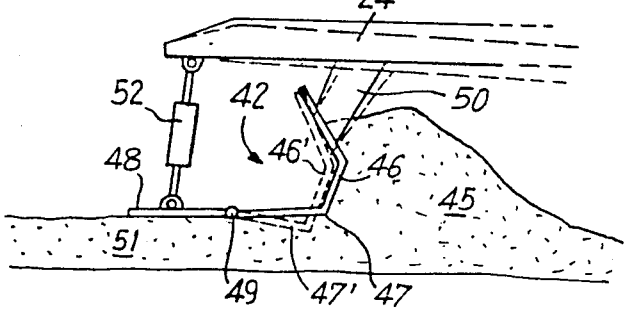
FIG. 3 is a diagrammatic view in longitudinal section of a portion of the tool shown in FIG. 1.

Upper molding element 42, as FIG. 3 shows more in detail, has a front part 46 which exhibits the form of a rigid shield exhibiting a lower leading edge, or front nose 47, made as will be seen in greater detail below to regulate the introduction of concrete, accumulated in sufficient amount at 45, in the molding means. Front shield 46 is mounted rigidly on the back part of hitching arms 24 by two vertical standards 50, welded and/or bolted on the arms.

Figure 4:
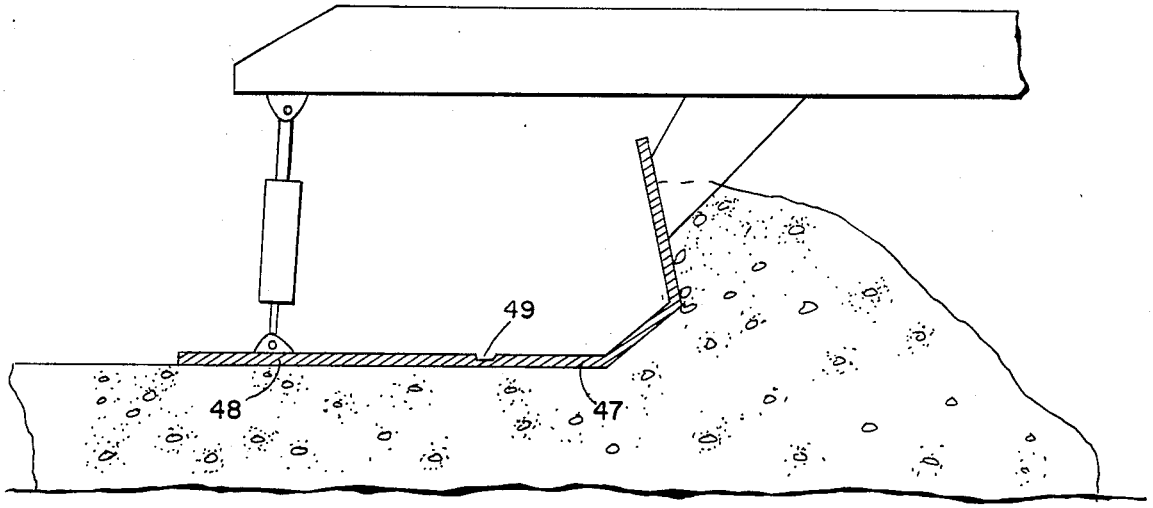
FIG. 4 shows an alternative embodiment of the portion of the tool shown in FIG. 3.

Upper molding element 42 further comprises a back plate-shaped part 48 which performs the forming itself. Back plate 48 is made to be able to take a certain longitudinal inclination in relation to the rigid part of shield 46, for purposes explained below. This degree of freedom of articulation can be assured in any manner (not shown in detail). For example, there can be provided between the back edge of part 46 and the front edge of part 48 a hinge mechanism, diagrammatically indicated as 49 in FIG. 3. Another possibility, shown in FIG. 4, consists in designing parts 46 and 48 as one piece, providing, however, at the connection of said parts a zone of thickness sufficiently small to allow a certain angular clearance of part 48 in relation to rigid part 46.

Between back plate 48 and the back end of hitching arms 24 are provided support means, made to keep said plate 48 in correct alignment in relation to molded concrete layer 51 (FIG. 3), to give the tool according to the invention its self-supported characteristic. However, it is understood that the vertical distance between this back plate 48 and the back ends of arms 24 varies when the angle between shield 46 and plate 48 varies. Therefore, for the support means there will be provided a device with hydraulic jacks, indicated as 52, or further, a device with compression springs, so that this support (more precisely the transmission to arms 24 of the reaction force exerted on the tool by freshly deposited concrete layer 51) is assured regardless of the vertical distance mentioned above.

As has been mentioned, the molding means comprise in this embodiment two side molding plates **44*a* and 44*b*. As FIG. 1 shows, side plate 44*a* is approximately rectilinear, while plate 44*b* exhibits a set back, indicated as 44*b*', thus extending the mold laterally to the outside in relation to the associated arm. This illustrates the fact that the side molding plates can take any desired shape to obtain a form of any width, greater or less than the space between the two hitching arms 24**.

Each side plate **44*a*, 44*b* is mounted on the tool with vertical play, for purposes explained below. More specifically, the front part of each side plate has a small tongue 56 directed upward and made to slide vertically in an associated housing made in an intermediate region of associated arm 24. Further, diagrammatically indicated as 58 are assembly means with vertical sliding of the back region of each side plate 44*a*, 44*b* on the side of rigid shield part 46** of the upper forming element. Of course in the case of widening a road, the molding plate located on the side of the existing road will be eliminated, its role then being performed by the side edge of said road.

Finally, and optionally, the concrete tool according to the invention comprises altimetric guide means in the form of a crank feeler 66 which is mounted to swivel in a stationary box 68 mounted to project in relation to associated arm 24 by two standards 70 and 72 arranged in a "V." A guide wire (not shown) is stretched along the entire path that the tool associated with its tractor-feeder device must travel and cooperates with feeler 66, in a standard way, to provide constantly in real time position information representative of the variations in height of the front part of the hitching arms in relation to the reference height defined by the guide wire, to act, for example by a standard associated chain, on the height of the hitching point of associated arm 24 on the frame of the tractor-feeder device, by jack 34 described about. In case it is provided, this altimetric guide means could either be rounded out by an identical means (not shown) associated with the other arm, or by a swinging device (also not shown because it is standard).

The concrete tool as described above functions in the following way:

First, a tractor-feeder device of any type, to which the tool is hitched, deposits and distributes upstream from this latter a suitable amount of concrete cement, indicated as 45 in FIG. 3. The hitched tool advancing in the direction of arrow 18, while being drawn as has been said by its two arms 24, the concrete is first subjected to the action of immersion vibration needles 40, in a standard manner, to keep it in a relatively liquid state until the time of molding. Then the concrete is introduced into the molding part itself, consisting of upper element 42 and side plates **44*a* and 44*b*. For this purpose, front nose 47 serves as a device for metering or regulating the amount of concrete introduced into the mold, to give the tool a self-levelling characteristic. Actually, with reference to FIG. 3, it is understood that any lowering of the hitching point of arms 24, for example when a descent is begun, causes a corresponding lowering of shield 46, and therefore of solid front nose 47 (positions in broken lines indicated as 46' and 47'), thus to reduce gradually the thickness of formed concrete layer 51**.

Moreover, during all these movements of part 46 of upper forming element 42, whether they are planned or accidental (for example, during the presence of unevennesses on the traveling path of the tractor-feeder device), it is understood that the angular clearance mentioned above between parts 46 and 48 makes it possible for part 48, which constitutes the upper molding part itself of the tool, to maintain an orientation that is approximately parallel to the upper surface of concrete layer 51, to assure satisfactorily the support of the tool simply by said layer (self-supporting or floating characteristic), by support means 52 with compensation for variation in height as described above. Moreover, this solution makes it possible to make a concrete slab of extremely satisfactory smoothness, no defect being able to be created at its upper surface by unwanted movements of said back molding plate 48, on the contrary in addition to serving as a means of support for the tool on the concrete layer, serving as a means for smoothing said layer.

The tool according to this invention thus appears in the form of a self-supporting and smoothing form, thanks to the specific shape used for upper molding element 42.

Moreover, it can be noted that the possible longitudinal impacts to which the device which pulls the tool will be subjected will advantageously not be transferred to the tool itself, thanks to the horizontal play mentioned above which is allowed by the design itself of the elements for attaching the arms to said device. Also, the vertical clearance allowed for side plates **44*a* and 44*b*** advantageously makes it possible to free the form from the unevennesses of the ground in the region of the contact, by gravity, of said plates with the ground.

Of course, this invention is absolutely not limited to the embodiment described in detail above, but includes any variant or modification that a person skilled in the art can bring to it.

In particular, the tool can easily be adapted to making concrete slabs of any crosswise shape, particularly roof or gutter shape. In this case, an upper molding element having a shield in two parts slightly inclined to one another will be provided. The unwanted gap which then can appear between the two corresponding parts of the back plate for certain relative longitudinal inclinations can be prevented by the use of a continuous, flexible sheet, of plastic or the like, which will extend along the entire lower surface of the upper forming element and will advantageously smooth out the various unevennesses that can be present on said low surface because of the deformable character of said upper element.

Of course, such a flexible sheet can also be used in the tool as described above. In particular, it will make it possible to prevent an excessive inclination between the two parts 46 and 48 from damaging the upper surface of the formed concrete layer, by rounding the edge associated with such an inclination.

Moreover, the tool as described, and more particularly needle ramp 40, upper forming element 42, and side forming plates 44 can be designed in modular fashion to be able to cause its width easily to vary by simple addition or elimination of sections of elements bolted to one another.

Further, the self-levelling ability in certain cases makes it possible to do without the altimetric guide means as described above.

It will be noted that the internal vibration means as described above can be replaced by any suitable external vibration device.

Finally, according to a variant embodiment, the crosswise position of the forming tool can be made to vary in relation to the feeding tractor device by installing, for example on an arm 24 as indicated in FIG. 1, a jack 74 whose end 76 is secured to the tractor device. Jack 74 is controlled by a guide wire (or any other longitudinal reference system)—not shown here—which makes it possible for the mold, according to the same operating principle as said combination of elements 34 and 66, to follow a different path from that of the tractor device. This improvement makes it possible, during the placing on the ground of concrete slabs, to assure a very precise joint between two adjacent slabs.

What is claimed is:

1. A molding tool of the sliding mold type for the formation of cementitous concrete slabs form freshly deposited cementitous concrete, made to be tractor-drawn by any tractor-feeder unit able to deposit the cementitous concrete on the ground in a predetermined amount, comprising:

two hitching arms able to be mounted to pivot at their front end, for purposes of traction;

immersion vibration means mounted downstream from the tractor-feeder unit and made to subject the freshly deposited cemetitous concrete to a vibration; and molding means, including:

side elements for confinement of the freshly deposited cementitous concrete;

an upper element having a back part forming an upper molding plate for floating said tool on an upper surface of a layer of freshly deposited cementitous concrete beneath said back part, means for transmitting a reaction force of said layer of said freshly deposited cementitous concrete beneath said back part to said arms; and a front part rigidly mounted in a region at a back end of said arms donwstream from said immersion means, said front part and said back part being attached to each other along longitudinal edges thereof, said front part being upwardly inclined form said back part, whereby said tool is floatable and is supported solely upon said upper surface.

2. A tool according to claim 1, wherein further comprising, a continuous flexible sheet fastened to the front part of the upper element and extending over the lower surface of the upper element.

3. A tool according to claim 1, wherein the upper element exhibits a cross-sectional profile corresponding to the cross-sectional profile of the concrete slab to be molded.

4. A tool according to claim 1, wherein the front of each arm is horizontally pivotable.

5. A tool according to claim 1, wherein the side elements are mounted to the upper element and to the arms and have vertical play.

6. A tool according to claim 1, wherein the immersion vibration means subject the concrete to an internal vibration.

7. A tool according to claim 1, wherein, a jack is mounted on one of the arms of said forming means, a free end of the jack being secured to said tractor-feeder, the jack being controlled by a longitudinal reference system to adjust the crosswise position of the molding means in relation to the tractor.

8. The device of claim 1, wherein said back part is pivotable within a restricted range about the longitudinal edge of said first part to which it is joined in response to inclination and declination between said layer and said arms so that said back part remains essentially parallel to said upper surface of said layer.

9. A tool according to claim 8, wherein said pivoting is obtained by the use of a thinned region between the front and back parts.

10. The device of claim 8, wherein said transmitting means comprises a hydraulic jack or compression springs.

* * * * *